United States Patent [19]

Opfer

[11] Patent Number: 4,683,357

[45] Date of Patent: Jul. 28, 1987

[54] SWITCH-OPERATING MECHANISM WITH IMPROVED CHARGING ARRANGEMENT

[75] Inventor: John C. Opfer, Chicago, Ill.

[73] Assignee: S&C Electric Company, Chicago, Ill.

[21] Appl. No.: 810,796

[22] Filed: Dec. 19, 1985

[51] Int. Cl.[4] ..... H01H 3/30

[52] U.S. Cl. ..... 200/153 SC; 200/325; 335/76; 185/10; 74/2; 74/42

[58] Field of Search ..... 200/153 SC, 318, 320, 200/323-325; 335/76, 77; 74/2, 42; 185/10, 39

[56] References Cited

U.S. PATENT DOCUMENTS

| | | | |
|---|---|---|---|
| 2,846,621 | 8/1958 | Coggeshall et al. | 200/153 SC |
| 2,972,259 | 2/1961 | Favre | 200/153 SC |
| 3,139,761 | 7/1964 | Gindroz, Jr. | 74/42 X |
| 3,875,360 | 4/1975 | Rys | 200/153 SC |
| 3,956,942 | 5/1976 | Seki et al. | 74/52 |
| 4,246,628 | 1/1981 | Ikemizu et al. | 74/42 X |
| 4,578,551 | 3/1986 | Lin | 200/153 SC |

*Primary Examiner*—Stephen Marcus
*Assistant Examiner*—Ernest G. Cusick
*Attorney, Agent, or Firm*—James V. Lapacek

[57] ABSTRACT

A stored-energy switch operating mechanism is provided that includes a charging arrangement that reduces the peak forces required during the charging of the operating mechanism to store operating energy. The charging arrangement is responsive to a unidirectional input to accomplish the charging of the operating mechanism. In an illustrative arrangement, the operating mechanism includes a closing spring and an opening spring. During charging, the springs are sequentially charged prior to any switch-closing or switch-opening operation. The operating mechanism does not require the detachment of any components during either charging or switch operation. The charging arrangement, in an illustrative embodiment, is responsive to a unidirectional rotary input to a charging crank to sequentially drive a charging element in a first direction and then in a second, opposite direction. In the first direction, a first of the springs is charged and latched. In the second direction, the second spring is charged and latched. The operating mechansim is then ready for switch operation when required. For example, in a specific arrangement, the switch is open during charging. After charging and when it is desired to close the switch, the closing spring is released which causes the operating mechanism to close the switch. Thereafter, when it is desired to open the switch, the opening spring is released.

10 Claims, 20 Drawing Figures

A
B
C
54
46
64
48
74
42
72
65
44
52
40
60
90
75
32
14
50
30
92
70
78
88
86
10
12

2
42
54
56
50
30
53
65
52
55
48
66
32
64
60
40
74
76
73
72
70
77
90
88
80
82
84
86
78
92

42
48
60
66
64
65
40
32
54
56
50
30
53
52
55
74
76
73
70
72
77
78
90
88
92
86
80
82
84

42
54
56
50
30
57
53
52
55
65
48
32
40
64
66
60
70
73
74
96
76
72
77
90
92
86
78
80
82

42
54
50
56
55
52
53
65
64
67
48
32
40
66
60
74
76
70
73
72
77
92
90
88
78
86
82
80

SWITCH-OPERATING MECHANISM WITH IMPROVED CHARGING ARRANGEMENT

BACKGROUND OF THE INVENTION

1. Field of the Invention

The present invention relates generally to operating mechanisms and more particularly to a switch-operating mechanism including a charging arrangement that sequentially charges the energy storage means of the operating mechanism during an initial charging cycle before any switch-opening or switch-closing operation is performed.

2. Description of the Related Art

Various operating mechanisms are utilized to operate switches and the like between open and closed positions. In particular, operating mechanisms are desirable for switch applications wherein operating energy is stored for selectively closing a switch and for immediately thereafter being capable of opening the switch as required.

A first variety of operating mechanism provides for the charging of an opening spring during the switch closing operation. Examples of this type of mechanism are disclosed in the following U.S. Pat. Nos.: 4,453,056; 4,121,077; 4,105,878; 3,898,409; 3,845,263; 3,835,277; 3,784,764; 3,728,508 and 3,600,541. This type of operating mechanism requires a higher-capacity closing spring to perform the functions of both closing the switch and charging the opening spring. The requirement of a higher-capacity closing spring is, of course, undesirable since it also requires higher-capacity latching, driving and supporting arrangements.

Another variety of operating mechanism requires the detaching of the closing spring from the operating member during switch opening. This type of operating mechanism requires a relatively complex arrangement for the required detaching of the closing spring. U.S. Pat. No. 3,876,847 discloses an arrangement that sequentially charges the closing spring and then the opening spring. A spring charging handle is rotated in a first direction to charge the closing spring and is then rotated in the opposite direction to charge the opening spring. The arrangement includes the detaching of the closing spring during switch opening.

Operating mechanisms that avoid some of the drawbacks of the aforementioned approaches are disclosed in U.S. Pat. No. 4,124,790 and U.S. patent application Ser. Nos. 721,613 filed on Apr. 10, 1985 (now U.S. Pat. No. 4,578,551), in the name of C. H. Lin and No. 721,617 filed on Apr. 10, 1985 in the names of W. J. Hall et al., (now U.S. Pat. No. 4,636,602), both applications being assigned to the same assignee as the present application. These mechanisms provide for charging the opening and closing springs simultaneously and do not require the detaching of the closing spring during switch opening. However, the configuration of U.S. Pat. No. 4,124,790 is complex and is neither suitable nor desirable for many applications. For example, a switch operating drive lever assembly 69 is only indirectly latched through a collapsable toggle lever assembly 71. Further, the arrangement to latch the toggle lever assembly 71 is complex and requires a latching element that operates against moving latching surfaces. Accordingly, the arrangement in U.S. Pat. No. 4,124,790 includes complex, indirect latching and a complex arrangement to transmit force and movement from the drive lever member 123 to the switch operating member 77. However, these arrangements still require high peak forces during charging.

While the aforementioned arrangements may be generally useful and satisfactory for their intended use, it would be desirable to provide an operating mechanism with an improved charging arrangement that reduces the peak forces required during charging and that does not require the detaching of any spring during operation.

SUMMARY OF THE INVENTION

Accordingly, it is a principal object of the present invention to provide an operating mechanism that stores energy to selectively close a switch and to immediately thereafter be capable of opening the switch as required, the operating mechanism including a charging arrangement that reduces the peak forces required during the charging of the operating mechanism and that is responsive to a unidirectional input.

It is another object of the present invention to provide a stored-energy operating mechanism for electrical switches that includes a charging arrangement that sequentially charges two or more energy storage means of the operating mechanism prior to the switch-closing and switch-opening operation and that does not require the detachment of any components during operation.

Briefly, these and other objects of the present invention are efficiently achieved by providing a stored-energy switch operating mechanism that includes a charging arrangement that reduces the peak forces required during the charging of the operating mechanism to store operating energy. The charging arrangement is responsive to a unidirectional input to accomplish the charging of the operating mechanism. In an illustrative arrangement, the operating mechanism includes a closing spring and an opening spring. During charging, the springs are sequentially charged prior to any switch-closing or switch-opening operation. The operating mechanism does not require the detachment of any components during either charging or switch operation. The charging arrangement, in an illustrative embodiment, is responsive to a unidirectional rotary input to a charging crank to sequentially drive a charging element in a first direction and then in a second, opposite direction. In the first direction, a first of the springs is charged and latched. In the second direction, the second spring is charged and latched. The operating mechanism is then ready for switch operation when required. For example, in a specific arrangement, the switch is open during charging. After charging and when it is desired to close the switch, the closing spring is released which causes the operating mechanism to close the switch. Thereafter, when it is desired to open the switch, the opening spring is released. Each of the springs may include two or more individual springs acting in parallel.

BRIEF DESCRIPTION OF THE DRAWING

The invention, both as to its organization and method of operation, together with further objects and advantages thereof, will best be understood by reference to the following specification taken in conjunction with the accompanying drawing in which.

DETAILED DESCRIPTION

Figure 1:
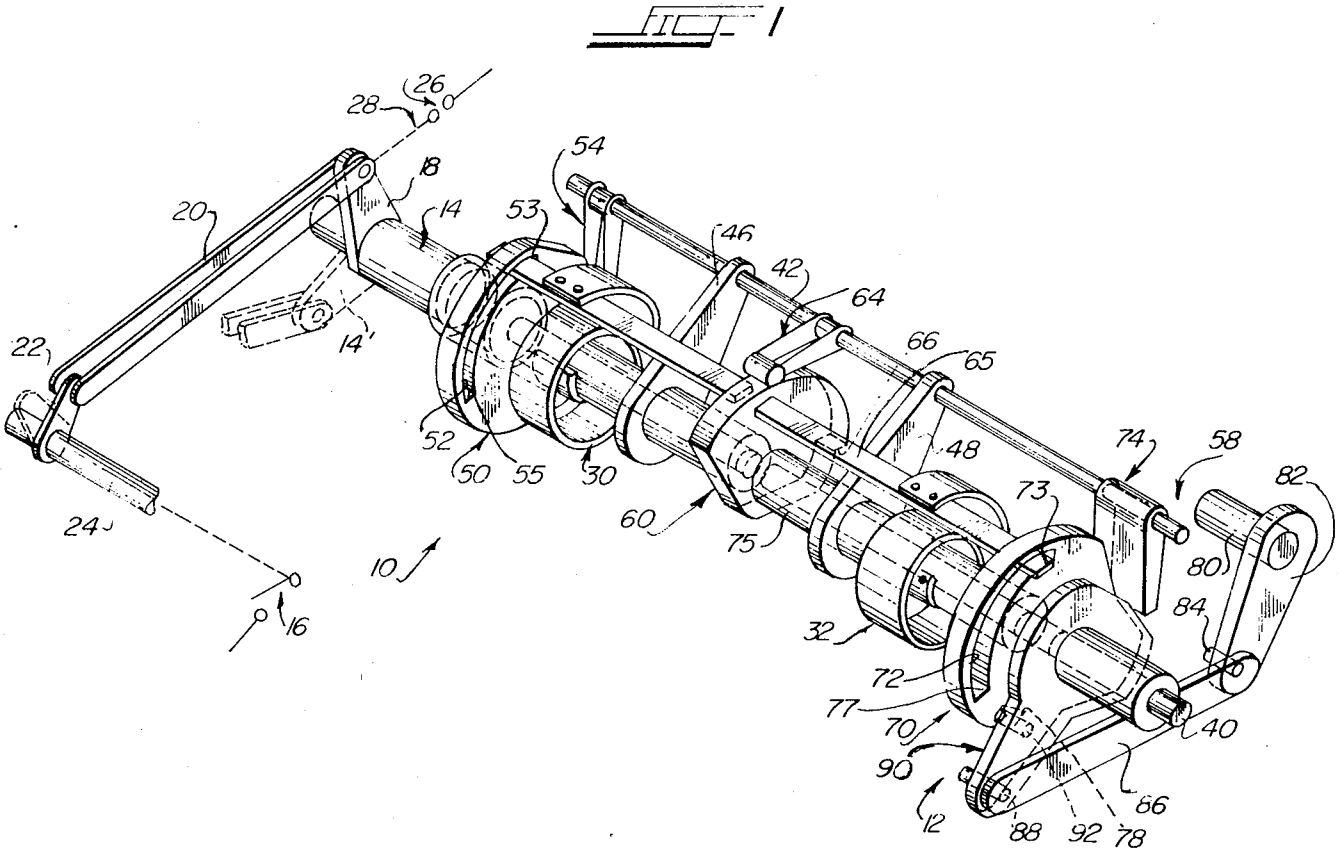
FIG. 1 is a perspective view of the operating mechanism of the present invention.
Figure 2:
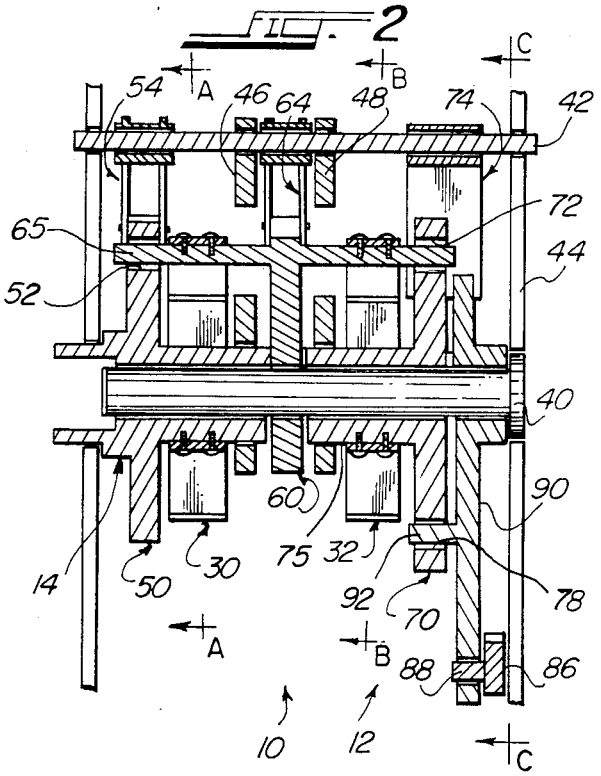
FIG. 2 is a sectional view of the operating mechanism of FIG. 1.

Referring initially to FIGS. 1 and 2, the operating mechanism 10 of the present invention includes an improved charging arrangement 12 and an operating member 14. Rotation of the operating member 14 defines two operating positions of an electrical switch represented in FIG. 1 at 16. In the arrangement of FIG. 1, the operating member 14 includes an arm 18 that extends generally perpendicularly from the operating member 14. An operating link 20 couples movement of the arm 18 to a lever 22 that extends perpendicularly to a switch operating strut 24. However, it should be understood that various control linkages are provided in other arrangements. For example, in another arrangement the operating member 14 directly drives a rotary-actuated switch. In yet another arrangement, the arm 18 controls a switch 26 through suitable linkage referred to generally at 28. It should also be understood that while the present invention is illustratively described for operating switches, in other arrangements the operating mechanism 10 is utilized to operate valves, gates, etc., especially where a rapid reversal of a specific operative state is required. Further, the operating mechanism 10 may be arranged with a reversal of the open and closed operating positions.

In accordance with the features of the present invention, the operating mechanism 10 receives a unidirectional charging input in the direction 58, and as desired thereafter, the operating mechanism 10 is selectively operable to close the switch 16 via movement of the output shaft 14 in a first direction, e.g. counterclockwise, and is immediately thereafter capable of being selectively operable to open the switch 16 via movement of the output shaft in a second direction, e.g. clockwise, opposite to the first direction. The operating mechanism 10 includes a closing spring 30 and an opening spring 32. The closing spring 30 and the opening spring 32 are sequentially charged by the charging arrangement 12 via rotation in the direction 58 such that the peak charging force is reduced (approximately halved for equally-charged springs) as opposed to charging both springs simultaneously. Accordingly, the requirements of the means for driving the charging arrangement 12 at 58 and the components of the charging arrangement 12 are also reduced. Further, there is no requirement for the decoupling of either spring during operation of the switch 16.

The operating member 14 is rotatably supported on a support shaft 40. The operating member 14 includes a closing cam 50 that is either fixedly carried by the operating member 14 or is fabricated as an extending portion of the operating member 14. An opening cam 60 is rotatably supported on the suport shaft 40 and fixedly carries an elongated carriage 65; the combination of the opening cam 60 and the carriage 65 can also be defined as a control member. A charging cam 70 is also rotatably supported on the support shaft 40 and includes a tubular extension 75. The opening spring 32 operates between the carriage 65 and the tubular extension 75 of the charging cam 70. The outer end of the opening spring 32 is affixed to the carriage 65 and the inner end is affixed to the tubular extension 75 of the charging cam 70. The closing spring 30 operates between the carriage 65 and the operating member 14. The outer end of the closing spring 30 is affixed to the carriage 65 and the inner end is affixed to the operating member 14. The closing cam 50 includes an arcuate slot 52 and the charging cam 70 includes an arcuate slot 72. The carriage 65 extends through the arcuate slots 52 and 72 for selectively transmitting movement to the closing cam 50 and the charging cam 70 as will be explained in more detail hereinafter.

Figures 3A, 3B, 3C:
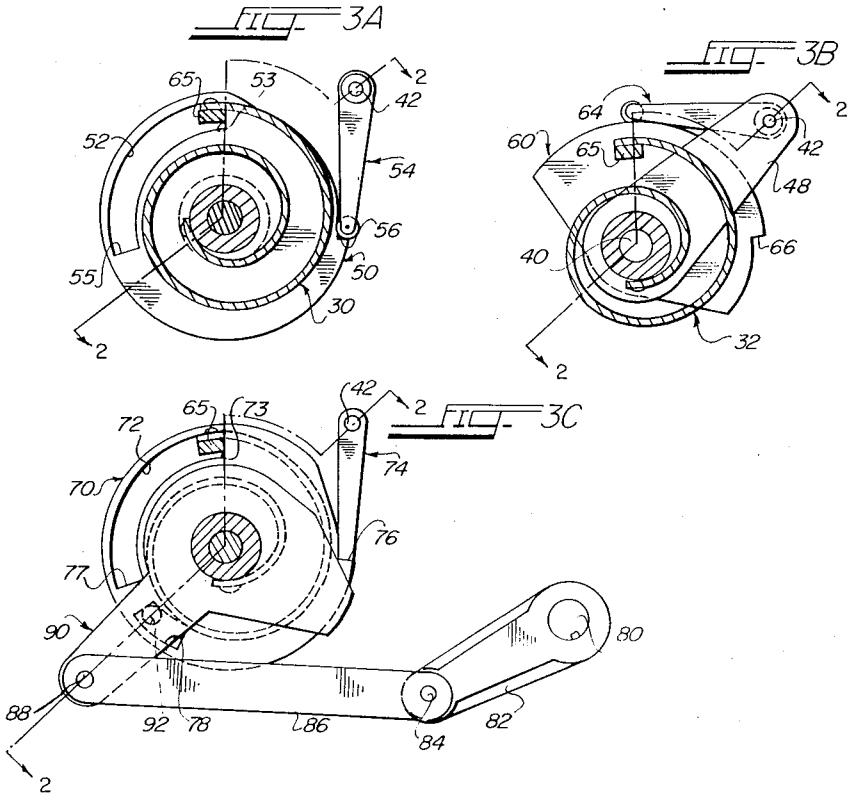
FIGS. 3 through 8 are sectional views taken along the respective section lines indicated in FIG. 2 illustrating the operating mechanism in different stages of operation.

With additional reference now to FIG. 3, a closing latch 54 cooperates with a cam surface of the closing cam 50 and a detent 56. Additionally, an opening latch 64 cooperates with a cam surface of the opening cam 60 and a detent 66. A charging latch 74 cooperates with a cam surface of the charging cam 70 and a detent 76. The latches 54, 64, and 74 are rotatably carried by a latch shaft 42 and may be characterized as first, second, and third latches respectively.

The charging arrangement 12 includes a charging shaft 80 which is rotatably supported with respect to a reference plane or housing 44 (FIG. 2) which also supports the support shaft 40 and the latch shaft 42. The charging shaft 80 is affixed to a charging crank 82. The charging crank 82 is pivotally connected at 84 to one end of a link member 86. The other end of the link member 86 is pivotally connected at 88 to a charging lever 90. The charging lever 90 is rotatably supported on the support shaft 40. The charging lever 90 fixedly carries an extending pin or member 92. The charging cam 70 includes a second arcuate charging slot 78 which receives the pin 92. The charging cam 70 can be considered part of the charging arrangement 12.

Figures 4A, 4B, 4C:
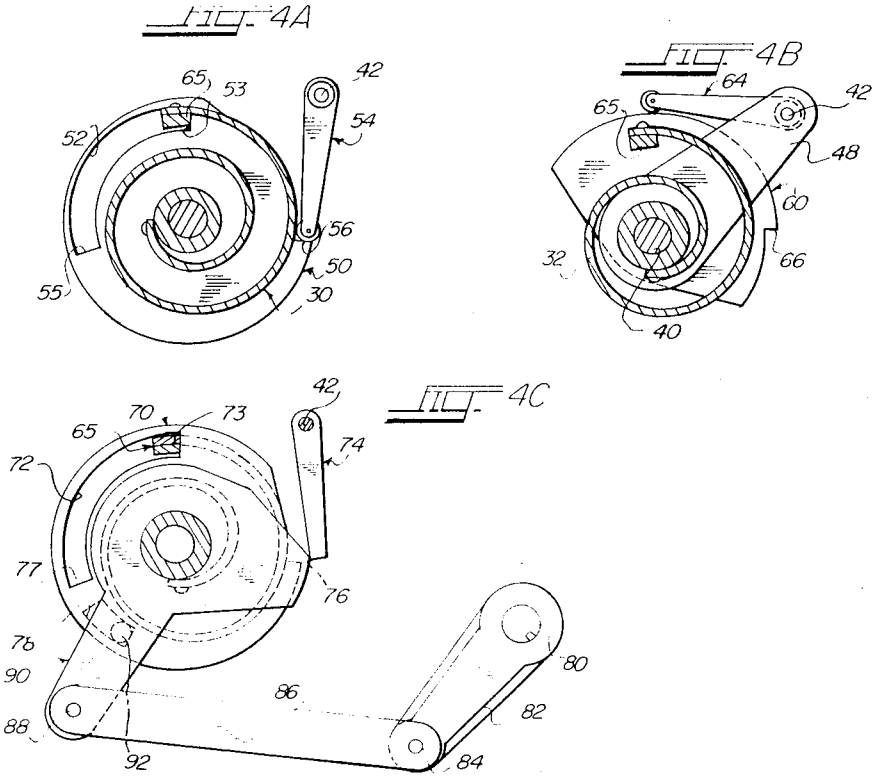

Considering now the operation of the operating mechanism 10 and with reference to FIGS. 3–4, prior to the charging cycle, the latches 54, 64 and 74 are in the positions shown in FIGS. 1 and 3; the closing latch 54 engaging the detent 56 of the closing cam 50, the opening latch 64 being disengaged, and the charging latch 74 engaging the detent 76 of the charging cam 70. Accordingly, prior to the charging cycle, the operating member 14 is latched against counterclockwise rotation due to the closing latch 54 engaging the detent 56. To initiate the charging cycle, the charging shaft 80 is rotated counterclockwise in the direction 58 with the charging arrangement 12 moving from the position of FIG. 3 to the position of FIG. 4 and the charging lever 90 rotating counterclockwise to the position of FIG. 4. Upon initial movement of the charging lever 90 from the position in FIG. 3, the charging latch 74 is lifted or released by the charging lever 90. As best seen in FIG. 2, the charging latch 74 is dimensioned and disposed to be proximate the charging lever 90 for release thereby upon rotation of the charging lever 90. Upon subsequent rotation of the charging lever 90, the pin 92 engages the right end (FIG. 4) of the slot 78 of the charging cam 70.

Figure 5B:
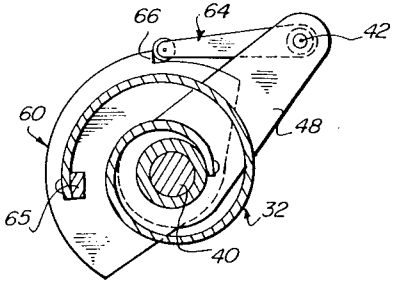
Figure 5A:
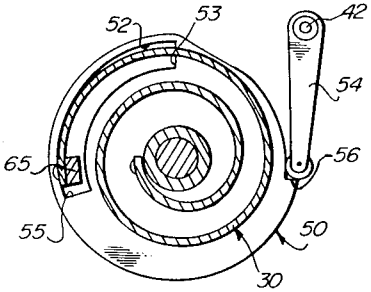
Figure 5C:
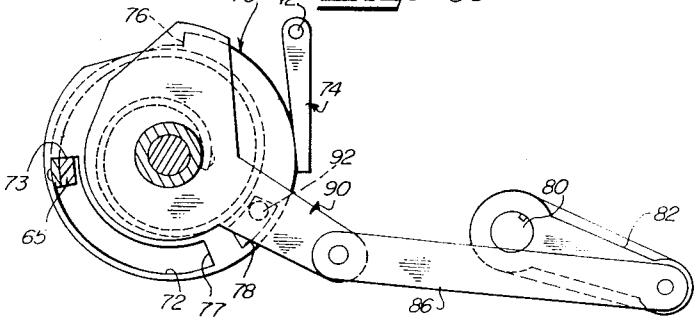

As the charging shaft 80 continues to rotate, the charging cam 70 is rotated from the position of FIG. 4 to the position of FIG. 5 with the charging cam 70 at the end 73 of the arcuate slot 72 acting against the carriage 65 to rotate the opening cam 60 and the carriage 65 to charge the closing spring 30; the carriage 65 moving from one end 53 of the slot 52 of the closing cam 50 toward the opposite end 55 as the closing cam 50 remains latched in a stationary position as seen in FIGS. 4 and 5.

During the portion of the charging cycle represented by FIGS. 3–5, the closing spring 30 is charged as the outer end moves counterclockwise and the inner end remains fixed. The opening spring 32 remains uncharged, i.e., in the initial state, since both ends of the opening spring 32 move together with no relative movement therebetween. At the point in the charging cycle represented by FIG. 5, the opening latch 64 engages the detent 66 of the opening cam 60, thus latching the carriage 65 and the closing spring 30 against clockwise movement and preventing the discharge of the closing spring 30.

Figure 6B:
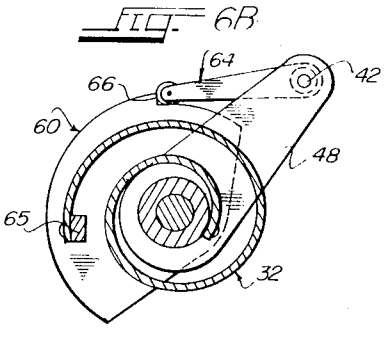
Figure 6A:
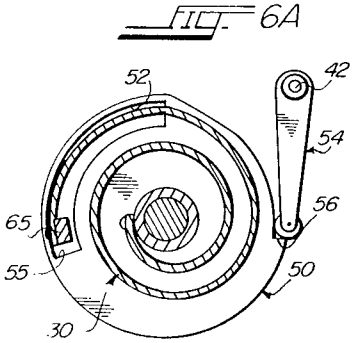
Figure 6C:
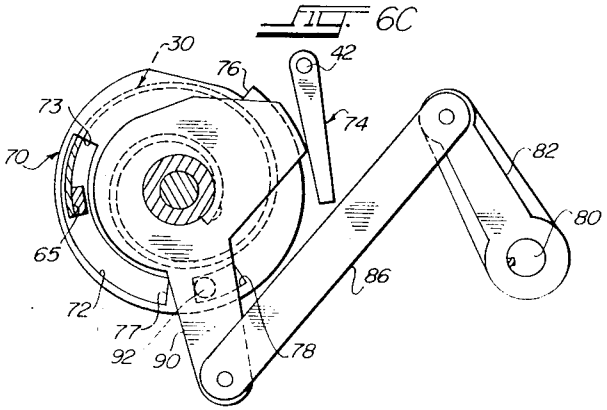

As the charging cycle continues with continued counterclockwise rotation of the charging shaft 80 in the direction 58, the charging lever 90 rotates from the position of FIG. 5 to the position of FIG. 6 with the pin 92 moving from the right end of the slot 78 to the left end; rotation of the charging lever 90 now being in the clockwise direction. With continued rotation of the charging shaft, the charging lever 90 and the charging cam 70 rotate clockwise to the position of FIG. 7. The inner end of the opening spring 32 is also rotated clockwise thereby charging the opening spring 32. During the charging of the opening spring 32 in the sequence of FIGS. 5–7, the outer end of the opening spring 32 is held stationary via the latched state of the opening cam 60 and the carriage 65.

Figures 7A, 7B, 7C:
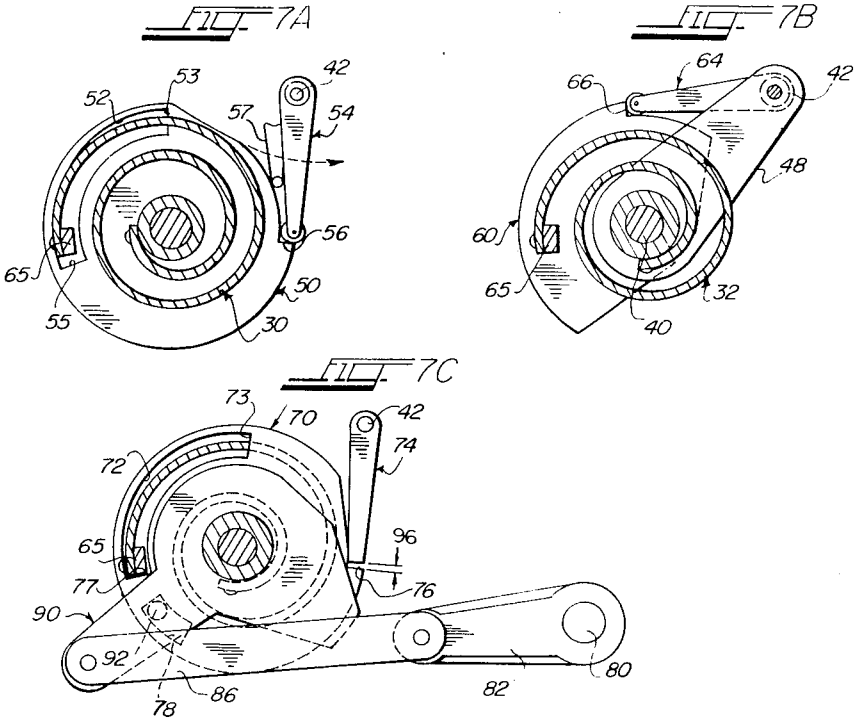

At the beginning of the charging of the opening spring 32 in FIG. 5, the carriage 65 is at the end 73 of the arcuate slot 72 of the charging cam 70. As the charging cam 70 is rotated clockwise and the carriage 65 remains fixed, the carriage 65 can now be seen in FIG. 6 to be positioned along the arcuate slot 72 away from the end 73. In FIG. 7, with continued clockwise rotation of the charging cam 70, the carriage is now at the other end 77 of the arcuate slot 72. At the end of the charging cycle as shown in FIG. 7, both the closing and opening springs 30 and 32 are charged. Additionally, the charging latch 74, which also functions as a holding latch, is shown in an overtravel condition referenced by the dimension 96. As the charging lever 90 reaches the position of FIG. 7, the charging cam 70 rotates counterclockwise and the charging latch 74 is loaded at the detent 76; the charging lever 70 now being latched against movement in the counterclockwise direction. At this point, the charging cycle is ended and rotation of the charging shaft 80 ceases.

At the end of the charging cycle, the latches 54, 64, and 74 are set in the latched condition such that the operating member 14, the carraige 65, and the charging cam 70 are each restrained against movement in response to the charged springs 30 and 32.

With the operating mechanism 10 in the charged state, whenever it is desired to thereafter close the switch 16, the closing latch 54 is moved to release the closing cam 50. Referring now to the sequence of FIG. 7 to FIG. 8, with the closing latch 54 released, the closing cam 50 rotates counterclockwise in response to the closing spring 30, and referring to FIG. 1 the operating member 14 rotates counterclockwise to close the switch 16; the closed position of the operating member 14 being illustrated at 14' and the closed position of the lever 22 being illustrated in phantom. During the closing operation, the carraige 65 is restrained against movement by the opening latch 64 such that the inner end of the closing spring 30 rotates with respect to the fixed outer end. During the closing operation represented by the sequence of FIG. 7 to FIG. 8, the movement of the closing cam 50 starts with the carriage 65 at the end 55 of the arcuate slot 52 and ends in FIG. 8 with the carriage 65 at the end 53 of the arcuate slot 52.

Figures 8A, 8B, 8C:
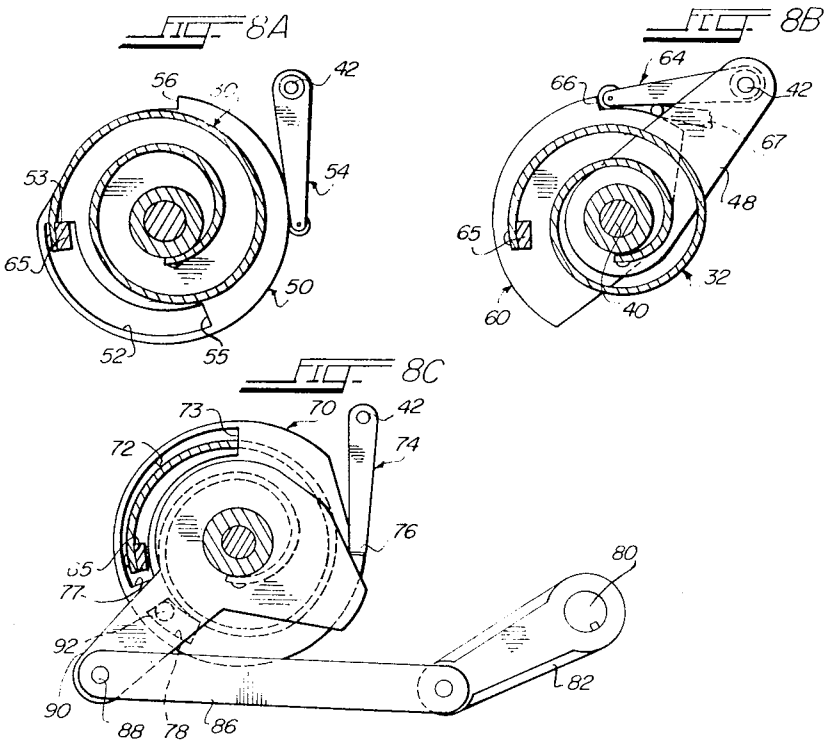

At any time thereafter when it is desired to open the switch 16, the opening latch 64 is released and the opening cam 60 and the carriage 65 rotate clockwise from their respective positions in FIG. 8 to those of FIG. 3. As the opening cam 60 and the carriage 65 rotate clockwise in response to the opening spring 32, the carriage 65 acts against the end 53 of the arcuate slot of the closing cam 50 to rotate the closing cam 50 and the operating member 14 clockwise to open the switch 16. As the operating member 14 rotates clockwise during the opening phase, both ends of the closing spring 30 move together so that the energy state of the closing spring 30 is unaltered. During the opening operation, the carriage 65 moves in the arcuate slot 72 of the charging cam 70 from the end 75 to the end 73. The operating mechanism 10 in the configuration of FIG. 3 is again ready for the charging cycle by the charging arrangement 12 as explained hereinbefore.

In accordance with the features of the charging arrangement 12 of the present invention and referring to FIGS. 4 and 5, it should be noted that as the charging crank 82 reaches the position of FIG. 5 corresponding to the end of the portion of the charging cycle for charging the closing spring 30, the geometry of the charging crank 82, the charging lever 90, and the connecting links 86 provide the maximum mechanical advantage of the charging crank 82 over the charging lever 90. This configuration serves to level out or reduce the variations in torque for rotating the shaft 80 as the closing spring 30 becomes charged. The same effect is provided at the end of the charging of the opening spring 32; e.g., as the configuration of FIG. 7 is reached.

As seen in FIGS. 1 and 2, in a preferred arrangement, a latch-shaft support 46 is provided between the latch shaft 42 and the operating member 14 and a latch-shaft support 48 is provided between the latch shaft 42 and the tubular extension 75. The latch-shaft supports 46 and 48 contain the force of the springs 30 and 32 and reduce the deflection of the latch shaft 42 in response to the charged springs 30 and 32. While the means for releasing the latches 54 and 64 do not form part of the present invention, in an illustrative arrangement, a closing latch trip lever 57 is provided as shown in FIG. 7 to release the closing latch 54 and an opening-latch trip lever 67 is provided as shown in FIG. 8 to release the opening latch 64.

While there have been illustrated and described various embodiments of the present invention, it will be apparent that various changes and modifications will occur to those skilled in the art. For example, one or more of the operating member 14, the opening cam 60, and the charging cam 70 can be supported on different support shafts separate from the support shaft 40. Further, the support shaft 40 may be fixed as described hereinbefore or may be rotatable along with the opening cam 60. Additionally, each of the springs 30 and 32 may be implemented by two or more springs arranged in parallel, series, etc. Still further, the springs 30 and 32 in other specific embodiments are extension springs. In a specific embodiment, the opening cam 60 is omitted and the opening latch 64 is directly operable on the carriage 65. It is intended in the appended claims to cover all such changes and modifications as fall within the true spirit and scope of the present invention.

What is claimed and desired to be secured by Letters Patent of the United States is:

1. An operating mechanism for a switch comprising:

an operating member movable in switch-opening and switch-closing directions;

a first selectively releasable latch for preventing movement of said operating member in said switch-closing direction;

a control member movable in first and second opposed directions between first and second positions;

a closing spring which acts between said operating member and said control member so that switch-closing energy is stored in said closing spring by movement of said control member in said first direction from said first position to said second position while said first latch prevents switch-closing movement of said operating member;

a second selectively releasable latch for preventing movement of said control member in the second direction whenever said control member has moved to the second position to store switch-closing energy in said closing spring;

a charging member movable in said first and second directions and including means for moving said control member in said first direction from said first position to said second position when said charging member is moved in said first direction;

an opening spring which acts between said control member and said charging member so that switch-opening energy is stored in said opening spring by movement of said charging member in said second direction while said second latch prevents movement of said control member in said second direction;

a third latch for preventing movement of said charging member in said first direction after said opening spring is charged with switch-opening energy; and means for moving said operating member in the switch-opening direction in response to movement of said control member from said second position to said first position, whereby movement of said charging member in said first direction followed by movement of said charging member in said second direction sequentially charges said closing and opening springs with switch-closing and switch-opening energy respectively, said operating member moving in the switch-closing direction in response to release of said first latch, subsequent release of said second latch allowing said operating member to be moved in the switch-opening direction.

2. The operating mechanism of claim 1 further comprising charging means responsive to a unidirectional input for moving said charging member in said first direction and subsequently moving said charging member in said second direction.

3. The arrangement of claim 1 further comprising charging means, said charging means comprises a charging lever for engaging and driving said charging member.

4. The arrangement of claim 3 wherein said charging member includes a slot and said charging lever includes a protuberance received within said slot of said charging member.

5. The arrangement of claim 3 wherein said charging member and said charging lever are each rotatable about a support axis.

6. The arrangement of claim 5 wherein said charging means further comprises a rotatable crank member and a link pivotally connected between said charging lever and said crank member.

7. The arrangement of claim 3 wherein said operating member and said charging member are rotatably mounted, said charging member including means for engaging said control member.

8. The arrangement of claim 7 wherein said moving means comprises means carried by said operating member for engagement by said control member.

9. The arrangement of claim 8 wherein said operating member and said charging member are rotatably supported about a common axis, said control member comprising an elongated member extending between said operating member and said charging member.

10. The arrangement of claim 1 further comprising a charging lever movable in said first and second directions, said charging lever including means for moving said charging member and means for unlatching said third latch before charging.

* * * * *